US006032715A

United States Patent [19]

Ohkubo et al.

[11] Patent Number: 6,032,715

[45] **Date of Patent: *Mar. 7, 2000**

[54] WAFER BONDING DEVICE

[75] Inventors: Yasunori Ohkubo; Hiroshi Satoh; Yoshihiro Miyazawa, all of Kanagawa, Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,570

[22] Filed: Jun. 26, 1997

[30] Foreign Application Priority Data

Jun. 28, 1996 [JP] Japan ..... P08-169105

[51] Int. Cl.[7] ..... B25B 11/00

[52] U.S. Cl. ..... 156/538; 269/21

[58] Field of Search ..... 156/DIG. 31, 538, 156/542; 269/21

[56] References Cited

U.S. PATENT DOCUMENTS

| | | | |
|---|---|---|---|
| 3,888,725 | 6/1975 | French | 156/556 |
| 4,856,766 | 8/1989 | Huberts | 269/21 |
| 5,324,012 | 6/1994 | Aoyama et al. | 269/21 |
| 5,329,733 | 7/1994 | Steere, Jr. | 51/165.76 |
| 5,437,832 | 8/1995 | Imamura et al. | 419/2 |
| 5,572,786 | 11/1996 | Rensch | 29/559 |
| 5,618,227 | 4/1997 | Tsutsumi et al. | 451/288 |
| 5,738,165 | 4/1998 | Imai | 165/80.2 |
| 5,857,667 | 1/1999 | Lee | 269/21 |
| 5,923,408 | 7/1999 | Takabayashi | 269/21 X |

*Primary Examiner*—Curtis Mayes
*Attorney, Agent, or Firm*—Hill & Simpson

[57] ABSTRACT

A wafer bonding device which prevents the substrate from being deformed due to the presence of any particles on the chuck surface is provided to thereby prevent a deterioration in yield in the wafer bonding process. The wafer bonding device is equipped with a substrate holding section 3 having a chuck surface 9 for holding a substrate 1, which is one of two substrates 1 and 2 to be bonded together, and the other substrate 2 is bonded to the substrate 1, which is held by the chuck surface 9, wherein a suction member 8 engaged with a support member 4, forming the substrate holding section 3, is formed of a porous material, whereby minute recesses of a predetermined size are formed in high density on the chuck surface 9 of the substrate holding section 3, and any particles are captured in these minute recesses.

4 Claims, 5 Drawing Sheets

WAFER BONDING DEVICE

BACKGROUND OF THE INVENTION

1. Field of the Invention

The present invention relates to a wafer bonding device for bonding two substrates together and, in particular, to a wafer bonding device suitable for use in bonding two silicon substrates together in a semiconductor manufacturing process.

2. Description of the Related Art

FIGS. 6A through 6F are process diagrams illustrating a process for preparing an SOI (silicon on insulator) substrate using a wafer bonding technique of this type.

In the preparation of this SOI substrate, first, as shown in FIG. 6A, patterning is performed on a first silicon substrate 30 by photolithography, etching or the like, and, on the uneven surface thereby formed, an insulating layer 31 consisting of $SiO_2$ is formed. Further, a polysilicon layer 32 is formed on this insulating layer 31.

Next, as shown in FIG. 6B, the surface of the polysilicon layer 32 is flattened by grinding, and then, as shown in FIG. 6C, using the polysilicon layer 32 as the joint layer, a second silicon substrate 33 is bonded.

Subsequently, as shown in FIG. 6D, the peripheral edge portion of the substrate is chamfered, and then, as shown in FIG. 6E, the surface of the first silicon layer 30 is ground. In this process, a portion 34 of the first silicon substrate 30 is left on the protruding surfaces of the insulating layer 31.

Finally, as shown in FIG. 6F, selective grinding is performed until the insulating layer 31 is exposed, whereby there is obtained a so-called element-separated device structure, in which silicon portions 34 exist in the recesses of the insulating layer 31.

Conventionally, when bonding the first and second silicon substrates 30 and 33 to each other, a wafer bonding device as shown in FIG. 7 has been used.

In this conventional device shown in FIG. 7, a suction member 51 is engaged with and secured to a support member 50 serving as the base, and grooves 52 are formed concentrically in the upper surface of the suction member 51, thereby forming a chuck surface 53. When bonding the substrates together, the first silicon substrate 30 is placed on the chuck surface 53, and evacuation is effected as indicated by the arrow in the drawing, whereby the first silicon substrate 30 is attracted to the chuck surface 53 by vacuum suction, and, in this condition, the second silicon substrate 33 is bonded.

However, the above-described conventional wafer bonding device involves the following problem when, for example, an airborne particle 54 falls and, as shown in FIG. 8, adheres to a chuck surface (protruding surface) 53.

That is, when vacuum suction is effected with the silicon substrate 30 having been placed on the chuck surface 53, the silicon substrate 30 is partially pushed up due to the presence of the particle 54, whereby the silicon substrate 30 undergoes deformation, such as swell. As a result, the flatness of the substrate 30 markedly deteriorates, and, when bonded to the other silicon substrate 33, the substrate 30 entails the generation of voids 55 in the vicinity of the deformed portion or pattern expansion on the substrate, resulting in a deterioration in yield in the bonding process.

SUMMARY OF THE INVENTION

The present invention has been made with a view toward solving the above problem in the prior art. It is an object of the present invention to provide a wafer bonding device which is capable of reliably preventing the substrate from being deformed due to the presence of any particles, thereby achieving an improvement in yield in wafer bonding process.

To achieve the above object, there is provided, in accordance with the present invention, a wafer bonding device of the type which is equipped with a substrate holding section having a chuck surface for holding one of two substrates to be bonded together, the other substrate being bonded to the one held by the chuck surface to thereby prepare a substrate, wherein minute recesses of a predetermined size are formed in high density on the chuck surface of the substrate holding section.

In the wafer bonding device described above, minute recesses are formed in high density on the chuck surface of the substrate holding section, so that, even if an airborne particle falls onto the chuck surface, the particle will be captured by one of the minute recesses mentioned above. Thus, the substrate held by the chuck surface will not be locally raised by the particle, whereby it is possible to reliably avoid deformation of the substrate due to the presence of a particle.

DESCRIPTION OF THE PREFERRED EMBODIMENTS

Embodiments of the present invention will now be described in detail with reference to the figures.

Figure 1:
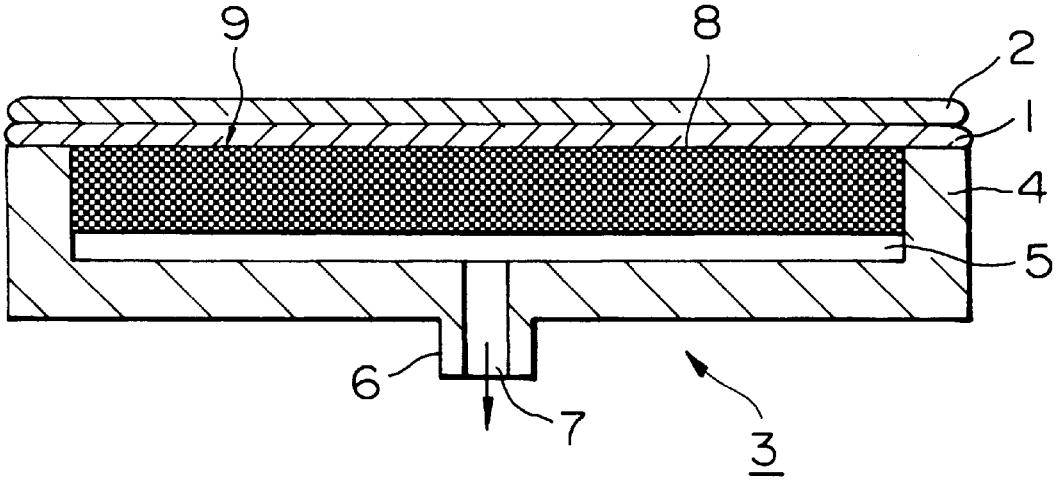
FIG. 1 is a side sectional view showing a wafer bonding device according to an embodiment of the present invention.

FIG. 1 is a side sectional view showing a wafer bonding device according to an embodiment of the present invention. In the wafer bonding device shown in FIG. 1, one of two substrates (semiconductor wafers or the like) 1 and 2 to be bonded together, the substrate 1 in this case, is held by a substrate holding section 3, and the other substrate 2 is brought from above close to the substrate 1 thus held, the respective joint surfaces of the substrates being bonded to each other.

The substrate holding section 3 includes a support member 4 which constitutes the base of the substrate holding section 3 and whose outer diameter is substantially the same as that of the substrates 1 and 2 to be bonded together. On the upper side of this support member 4, there is provided an engagement recess 5 having a predetermined depth. Further, at the center of the lower side of the support member 4, there is provided a protrusion 6 formed as an integral part of the support member, and a vent 7 communicating with the engagement recess 5 is provided in this protrusion 6.

Further, as a feature of the present invention, a suction member 8 formed of a porous material, for example, a porous ceramic is engaged with the engagement recess 5 of the support member 4, and a chuck surface 9 is formed by this suction member 8. Due to the above-mentioned porous material, minute recesses having a predetermined size (not shown) are formed in high density on the chuck surface 9. This suction member 8 consisting of a porous material is engaged with and secured to the engagement recess 5 such that the chuck surface 9 thereof is flush with the upper surface of the support member 4. Further, in the engaged state, a predetermined gap (air gap) is secured between the lower surface of the suction member 8 and the bottom surface of the recess of the support member 4.

In the above-described construction, the substrate 1 is placed on the chuck surface 9 of the suction member 8, and evacuation is effected through the vent 7 provided in the support member 4, with the result that a negative pressure is generated in the gap secured between the support member 4 and the suction member 8, a sucking force due to this negative pressure being generated uniformly over the entire area of the chuck surface 9, whereby the substrate 1 is attracted to the chuck surface 9 by vacuum suction, and, in this condition, it is bonded to the other substrate 2.

When the substrate 1 is not placed on the substrate holding section 3, the chuck surface 9 of the suction member 8 is exposed, so that, even if the entire device is installed in a clean space like a clean room, it is impossible to prevent minute airborne particles from falling onto the chuck surface 9. However, in this embodiment, the chuck surface 9 is formed by the suction member 8 formed of a porous material, and, by virtue of this porous material, minute recesses (not shown) are formed in high density on the chuck surface 9, so that, by appropriately setting the size of the minute recesses (the pore size of the porous material in this embodiment) according to the degree of cleanliness of the clean room or the like, it is possible to capture all particles 10 falling onto the chuck surface 9 in the minute recesses (not shown) on the chuck surface 9.

Figure 2:
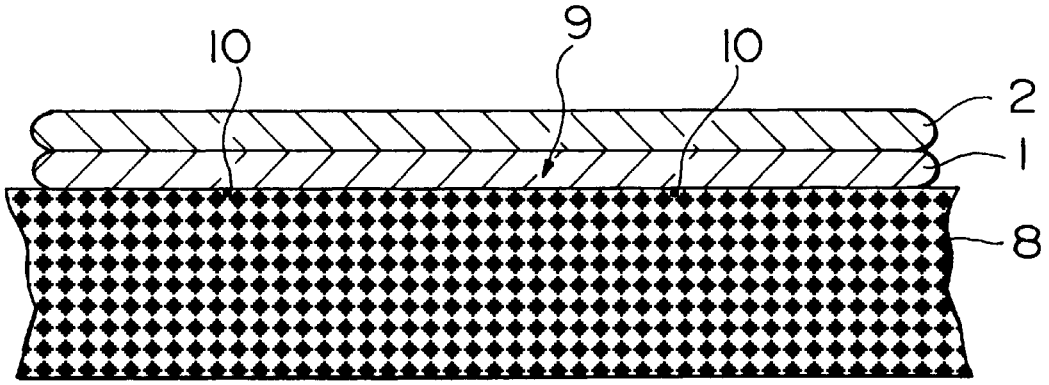
FIG. 2 is an essential-part sectional view showing the device with a substrate attracted thereto by suction.

Due to this arrangement, in the state in which the substrate 1 is placed on the chuck surface 9, the particles 10 are captured, as shown in FIG. 2, in the minute recesses (not shown), so that, when the substrate 1 is attracted by evacuation as described above, there is no concern that the substrate 1 will be locally raised due to the presence of the particles 10. As a result, the substrate 1 is prevented from being deformed due to the presence of the particles 10, whereby it is always possible to bond the substrates 1 and 2 together, with the degree of flatness of the substrate 1 being accurately maintained at a high level.

Further, in the formation of the chuck surface 9, if the suction member 8 is formed of a porous ceramic, which easily allows itself to be worked with high accuracy, it is possible to obtain a chuck surface 9 having a very high level of flatness, whereby it is possible to bond the substrates 1 and 2 together in a more preferable manner.

Figure 3:
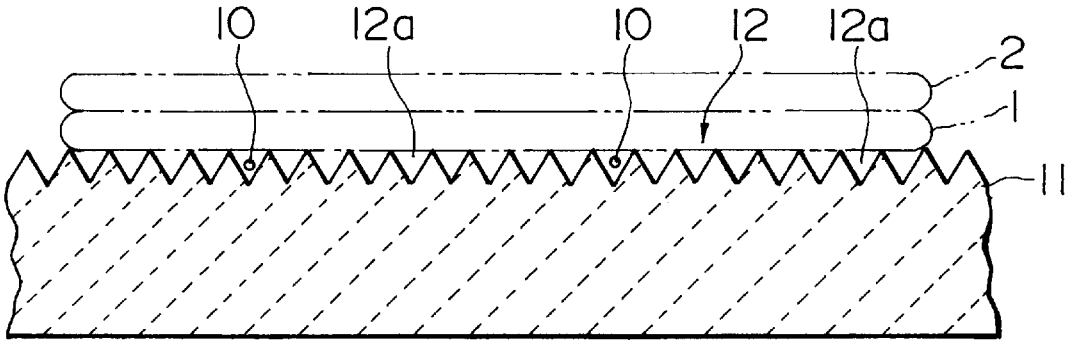
FIG. 3 is an essential-part sectional view (1) showing another embodiment of the present invention.
Figure 4:
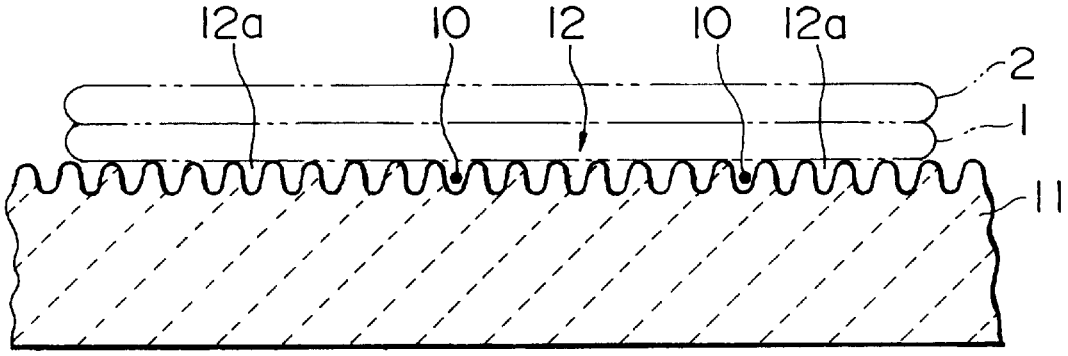
FIG. 4 is an essential-part sectional view (2) showing another embodiment of the present invention.

While in the above-described embodiment the chuck surface 9 is formed by the suction member 8 consisting of a porous material to thereby form minute recesses in high density on the chuck surface 9, this should not be construed restrictively. For example, according to another embodiment, as shown in FIG. 3, substantially angle-sectioned continuous protrusions and recesses, or, as shown in FIG. 4, substantially corrugated-sectioned continuous protrusions and recesses, are formed circumferentially on the upper surface 12 of a suction member 11 formed of a (non-porous) ceramic material, whereby minute recesses 12*a* having a predetermined size are formed in high density on the upper surface, i.e., the chuck surface 12, of the suction member 11.

Figure 5:
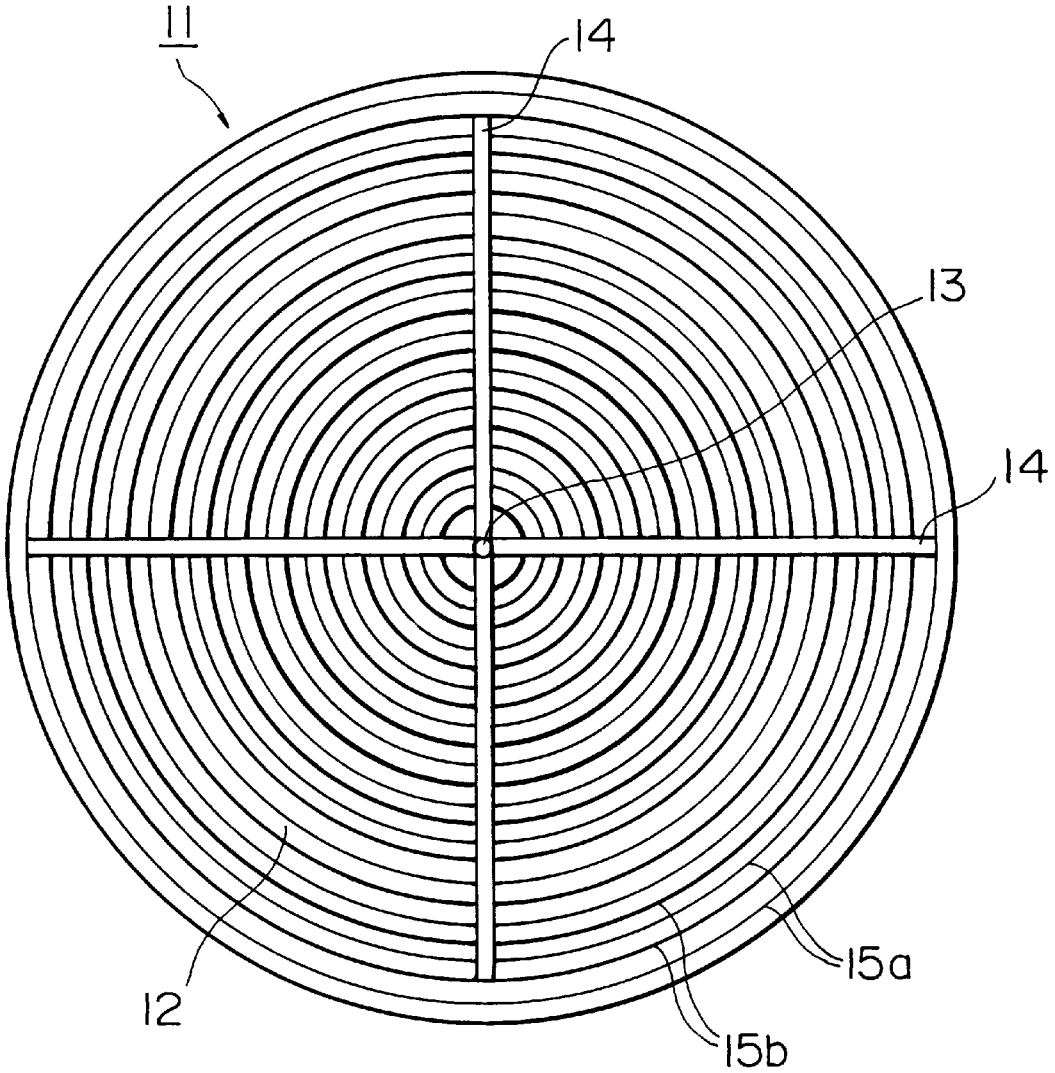
FIG. 5 is a plan view of the chuck surface according to another embodiment.
Figure 6A:
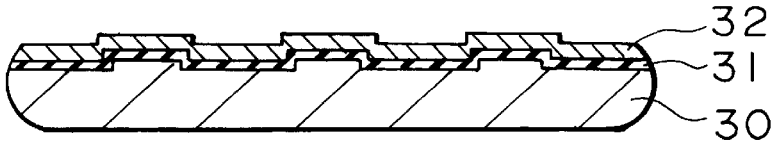
FIGS. 6A through 6F are process diagrams illustrating an SOI substrate preparing process using a wafer bonding technique.
Figure 6B:
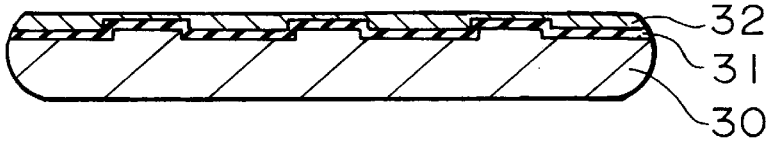
Figure 6C:
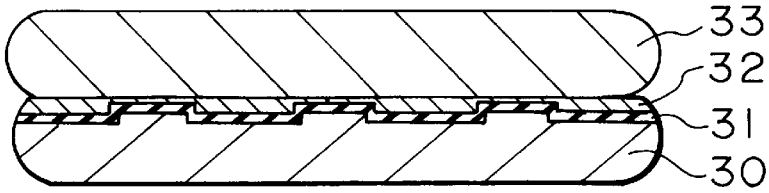
Figure 6D:
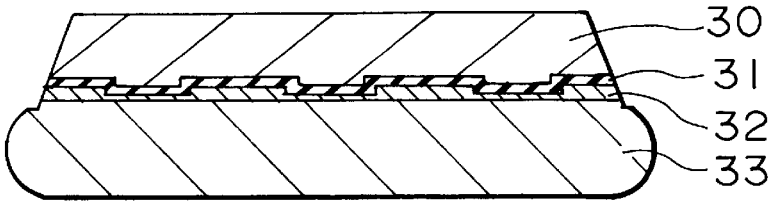
Figure 6E:
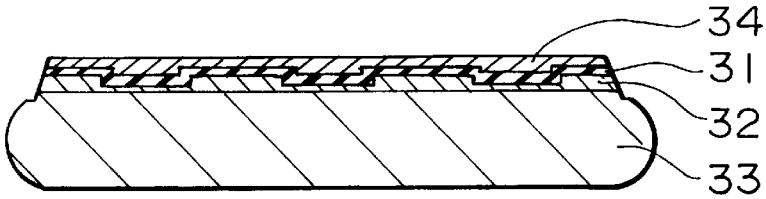
Figure 6F:
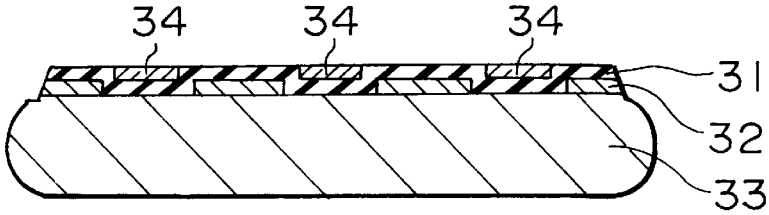
Figure 7:
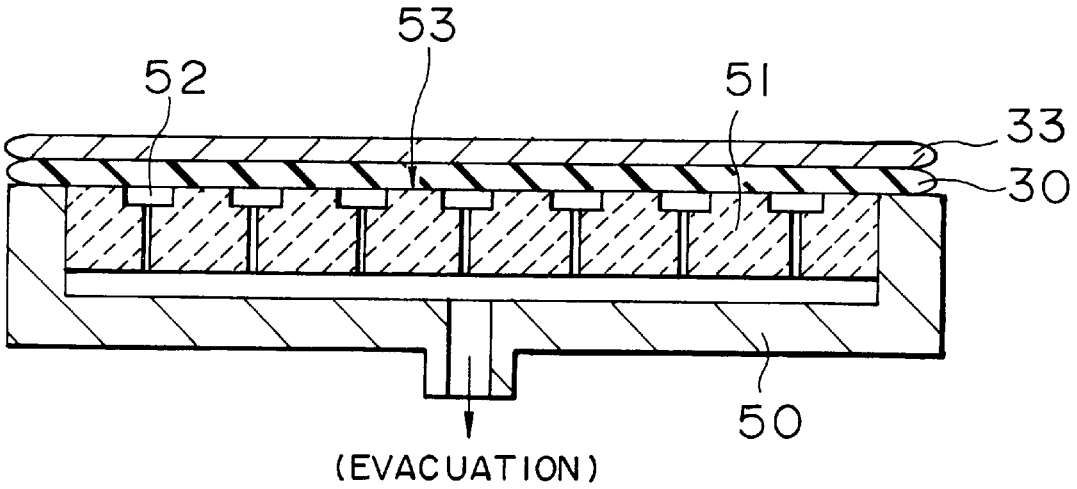
FIG. 7 PRIOR ART
FIG. 7 is a side sectional view showing a conventional wafer bonding device.
Figure 8:
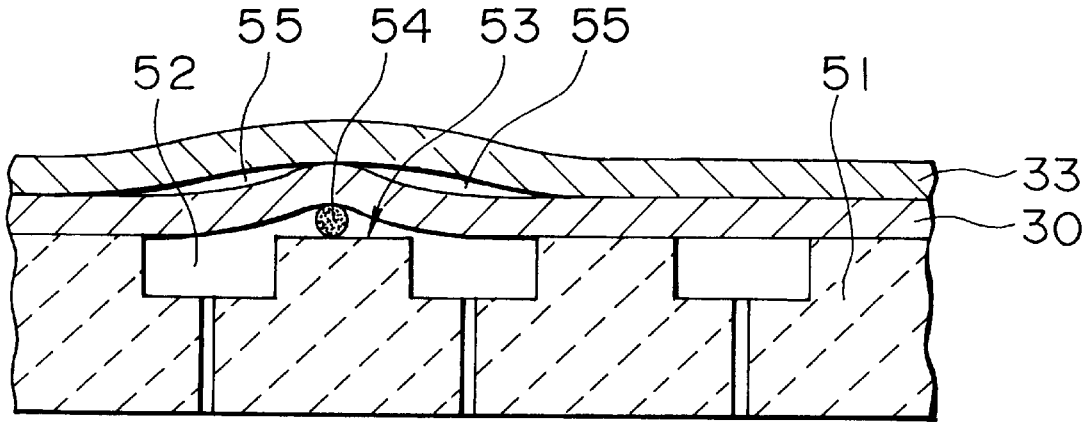
FIG. 8 PRIOR ART
FIG. 8 is a diagram illustrating the problem in the prior art.

When this suction member 11 is adopted, an evacuation outlet 13 is formed, as shown in FIG. 5, at the center of the chuck surface 12, and evacuation grooves 14 are formed so as to extend in four directions from the evacuation outlet 13, whereby the evacuation grooves 14 extend across the angle-sectioned or corrugated-sectioned continuous protrusions and recesses 15*a* and 15*b* formed on the chuck surface 12, so that, by effecting evacuation through the evacuation outlet 13 at the center, it is possible to generate a uniform sucking force over the entire area of the chuck surface 12.

In any case, in this embodiment, all the particles 10 falling onto the chuck surface 12 are captured in the minute recesses 12*a,* and the chuck surface 12 and the substrate 1 are in point contact or line contact with each other, so that it is possible to reliably prevent the substrate 1 from being deformed due the presence of particles 10, whereby it is possible, as in the above-described case, to bond the substrates 1 and 2 to each other in a stable manner.

Further, though not shown, according to still another embodiment, pointed pin-like protrusions, round-headed pin-like protrusions, etc. are formed in high density on the chuck surface, whereby minute recesses having a predetermined size are formed in high density.

As described above, in the wafer bonding device of the present invention, minute recesses having a predetermined size are formed in high density on the chuck surface of the substrate holding section, whereby any particles falling onto the chuck surface are all captured in the minute recesses, so that it is possible to reliably prevent the substrate from being deformed due to the presence of such particles.

As a result, in an SOI substrate preparing process in particular, it is possible, when bonding two substrates to each other, to bond them together in a stable manner without generating voids in the joint section or pattern expansion, variation, etc. on the substrate, so that it is possible to achieve a substantial improvement in terms of yield in the wafer bonding process. Further, as a result of the improvement in yield in the wafer bonding process, it is possible to omit the subsequent evaluation process (tape separation, etc.).

What is claimed is:

1. A wafer substrate holder comprising:

a cylindrical base having a top surface and a generally cylindrical engagement recess extending inwardly from an opening in the top surface to an end wall, said base further including a bottom surface opposite the top surface including a central cylindrical projection, said central cylindrical projection including a central bore extending from a vent opening in said end wall to a rear opening in an end surface of the central cylindrical projection, a chuck member flush mounted with respect to the top surface in said engagement recess, said chuck member comprising a porous material and having a wafer contact surface defined by a plurality of alternating concentric protrusions and grooves extending radially outwardly from a central portion of the wafer contact surface to a circumference of the wafer contact surface, a pair of diametrical evacuation channels disposed orthogonally with respect to each other and intersecting at a central hub adjacent the central portion of the wafer contact surface, the evacuation channels intersecting the plurality of grooves, a plurality of openings provided between each groove and the evacuation channels at points where they intersect; and a connector connecting the cylindrical projection to a vacuum source, said grooves in said wafer contact surface being configured and disposed so that upon application of vacuum suction through the connector to the central hub and evacuation channels, substantially all air born particles falling on said wafer contact surface are drawn into the grooves and away from said protrusions making contact with a wafer supported on the wafer contact surface.

2. A wafer substrate holder as defined in claim 1, wherein said top surface has an outer diameter substantially the same as a wafer adapted to be held by said wafer substrate holder.

3. A wafer substrate holder as defined in claim 1, wherein said protrusions have an angled cross-sectional configuration.

4. A wafer substrate holder as defined in claim 1, wherein said protrusions have a corrugated cross-sectional configuration.

* * * * *